United States Patent [19]

Vitt

[11] 4,142,323

[45] Mar. 6, 1979

[54] TRACK AND MOTOR WITH RESILIENTLY CONNECTED FLYWHEEL

[76] Inventor: Louis O. Vitt, 12319 Matthews La., St. Louis, Mo. 63127

[21] Appl. No.: 739,457

[22] Filed: Nov. 8, 1976

[51] Int. Cl.[2] ..... A63H 18/12; A63H 17/36

[52] U.S. Cl. ..... 46/257; 46/262; 104/151; 104/178; 104/230

[58] Field of Search ..... 46/1 R, 1 K, 59, 61, 46/62, 132, 202, 216, 206, 212, 257, 262, 263, 60, 63, 50; 273/86 R, 86 B; 104/112, 151, 173 R, 178, 230

[56] References Cited

U.S. PATENT DOCUMENTS

| | | | |
|---|---|---|---|
| 926,083 | 6/1909 | Vuillaume | 46/60 |
| 2,179,913 | 11/1939 | Bess | 104/151 |
| 2,601,006 | 6/1952 | Rodabaugh | 46/206 |
| 2,680,933 | 6/1954 | Laurens et al. | 46/60 |
| 3,000,138 | 9/1961 | Tagliaferri | 104/112 X |
| 3,336,878 | 8/1967 | Malakhoff | 104/178 X |

*Primary Examiner*—F. Barry Shay

*Attorney, Agent, or Firm*—Cohn, Powell & Hind

[57] ABSTRACT

This amusement device includes a suspended flexible track attached to a support at one end, and a motor driven device slidingly mounted to the track in guided relation. A control system is provided which includes a pair of elongate clutch elements wrapped around the motor shaft in opposite directions, the elements being operatively connected to the support at one end and to a control bar at the other end which is manipulated to provide speed and direction control. The track system includes dual, lengthwise extending track elements connected to the support to permit rotational movement of the track and the motor driven unit in a plane transverse to the direction of travel. A flywheel is mounted to the motor shaft by means of a resilient connection to provide the device with controlled gyroscopic action.

8 Claims, 6 Drawing Figures

TRACK AND MOTOR WITH RESILIENTLY CONNECTED FLYWHEEL

BACKGROUND OF THE INVENTION

This invention relates generally to amusement devices and in particular to a track-mounted device which is powered for travel along the track and is controlled by clutch action.

Amusement devices which travel on a suspended track are not in themselves new and are represented for example by U.S. Pat. Nos. 3,000,138, 3,611,632 and 3,935,667. The first of these patents discloses a toy flying saucer device, which is driven along a single flexible element by a self-contained motor having a shaft around which the track is wrapped in drive relation. The second patent discloses a self-propelled toy which is driven along a single flexible track by a motor drive guide wheel which engages the track. The third patent discloses a device which is driven along a track, which includes two track elements, by a self-contained motor having a shaft around which each track element is wrapped in drive relation. The frictional relationship between the track elements and the motor shaft are variable to adjust the speed and direction of the device. The present invention represents an improvement over the last, commonly owned patented amusement device.

SUMMARY OF THE INVENTION

This amusement device includes a flexible track means attached to a support means, and a motorized device slidingly mounted in guided relation on said track means, the speed and direction of said device being controlled by an independent clutch means.

The track means includes a pair of elongated track elements and the guide means includes a housing carried by the motor means receiving the track elements in guided relation.

The track elements are electrified and the housing includes apertured conductors receiving the track elements in electrically conductive sliding relation.

The shaft of the motor means carries a flexibly mounted flywheel and the track means is connected to the support means in rotatable relation in a plane transverse to the direction of travel to permit continuous transverse rotation of the device.

The clutch means includes a pair of elongate clutch elements, each wrapped at least one turn about said motor shaft means in frictional relation said turn of one of said elements being in the opposite direction to the turn of the other of said elements whereby to selectively drive said motor means on said track means in opposite directions.

The clutch means includes a transverse control member and connection means securing the same end of each of said clutch elements to spaced points on said control member whereby selective movement of said control member controls the tension in said clutch elements and thereby the speed and direction of the device.

The flywheel includes a resilient connection and is adjustably mounted on the shaft of the motor means and the motor means includes an elongate member extending oppositely of said shaft and carrying a lengthwise adjustable counter weight.

DESCRIPTION OF THE PREFERRED EMBODIMENT

Figure 2:
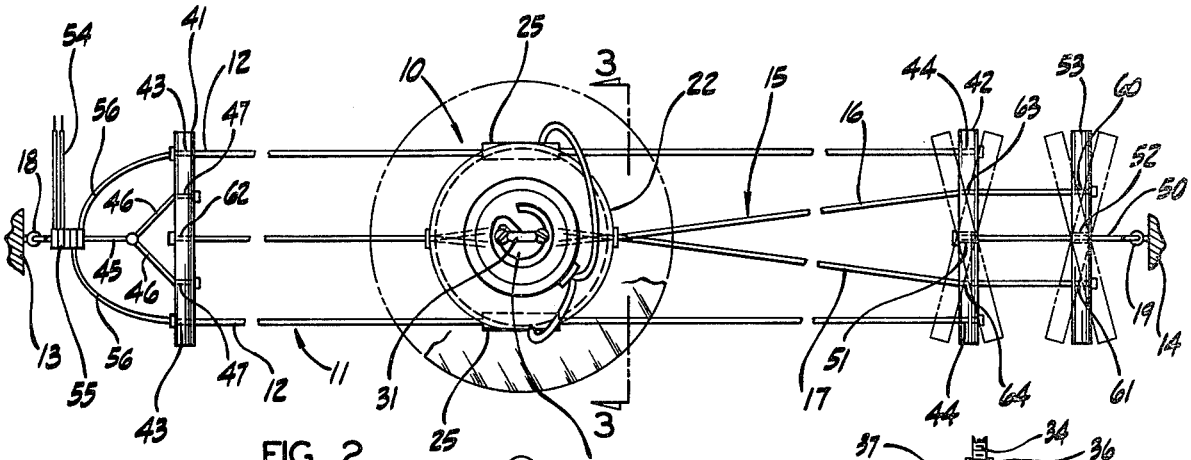
FIG. 2 is a plan view of said device.
Figure 1:
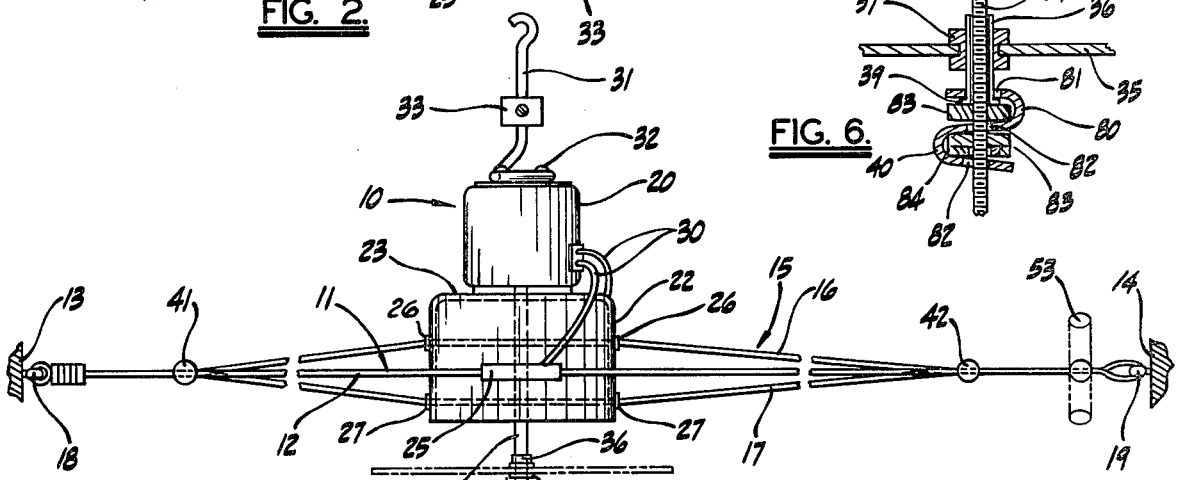
FIG. 1 is an elevational view of the amusement device.

Referring now by reference numerals to the drawings and first to FIGS. 1 and 2, it will be understood that the amusement device, generally indicated by numeral 10, is mounted for longitudinal travel along a flexible track system indicated by numeral 11. The track system 11 consists essentially of a pair of track elements 12 of copper or other electrically conductive material and is operatively attached between supports 13 and 14. The movement of the device 10 along the track system 11 is controlled by a control system which is generally indicated by numeral 15 and consists of a pair of clutch control elements 16 and 17.

More specifically, the device 10 consists essentially of an electric motor 20 having an elongate drive shaft 21, the motor being mounted to the track system 11 by means of a housing 22, which is formed of a suitable non-conductive material such as plastic and includes an end wall 23 to which the motor 20 is attached, as by fasteners. The housing 22 includes opposed notches 24, which receive and retain conductor sleeves 25 in fixed relation. Each sleeve 25 receives an associated track element 12 in sliding relation, and said sleeves provide a bearing means guiding and supporting said housing, and therefore said motor, along the track system 11. The housing 22 also includes upper and lower pairs of diametrically opposed apertures 26 and 27 respectively, said pairs of apertures receiving clutch elements 16 and 17 respectively, therethrough.

The motor 20 includes a pair of electrical leads 30 connected in conducting relation to associated conductor sleeves 25. A hook member 31 is mounted above the motor 20 by means of fasteners 32, and said hook member includes a counter-balance weight 33 adjustably mounted lengthwise of said hook member. The motor shaft 21 is provided with a lower threaded portion 34 for mounting a flywheel 35 of metal or of resilient material, such as rubber, or the like. The flywheel 35 is provided with a hub 36 which is a slip-fit over the shaft threads and includes a resilient external sleeve portion 37, said sleeve portion being attached to the flywheel 35 to provide a resilient connection between the flywheel 35 and the shaft 21 to permit flexing of said flywheel relative to said motor shaft.

Figure 6:
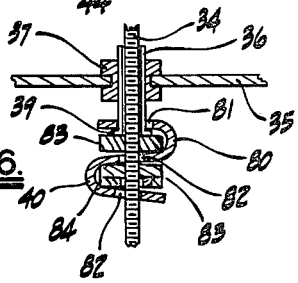
FIG. 6 is an enlarged fragmentary view of the friction strap assembly.

As shown in FIG. 6 the hub 36 is flared at the lower end 39 to retain a friction strap assembly 40. The strap assembly 40 includes a pliable, perforated strap 80 having an upper end opening 81 which receives the hub 36 and spaced openings 82 which receive the shaft threaded portion 34. Nut elements 83 are provided between each loop of the strap 80 and the provision of one or more spacer elements 84 permits the strap 80 to be tightened to a greater or lesser extent thereby varying the lateral force exerted on nuts 83 and in consequence determining the frictional resistance to rotation of said strap assembly 40. Because of the connection between the flywheel hub 36 and the strap assembly 40, said flywheel and said strap assembly tend to rotate together with the motor shaft 21 and the strap assembly 40 provides the flywheel with a threaded connection having frictional resistance to rotation relative to the shaft 21. The strap assembly 40 and the flywheel 35 rotate relative to the shaft 21 when the acceleration or deceleration forces are sufficient to overcome the frictional resistance of the strap assembly 40. When this occurs said strap assembly and flywheel move together longitudinally of the motor shaft 21. Further, the resilient connection between the flywheel 35 and the motor shaft 21 permits rotation of said flywheel in a plane other than the normal plane perpendicular to the motor shaft. A limit stop 38 is provided at the remote end of the shaft 21 to limit downward movement of said flywheel 35 and strap assembly 40.

The elongate flexible elements 12 of the track system 11 are disposed in side-by-side relation and extend between end insulator members 41 and 42, said members being provided with retaining apertures 43 and 44 respectively, receiving said track elements 12. The track elements 12 are slidingly received within the conductor sleeves 25, which permits movement of the device 10 relative to said track elements. The track system 11 is connected at one end to the fixed support 13 by means of a support element 45 attached to a screw 18, said support element having bifurcated portions 46 received within retaining apertures 47 provided in insulator member 41. The track system 11 is connected at its other end to the fixed support 14 by means of a support element 50 attached to a screw 19, said support element 50 being received within a retaining aperture 51 provided in the insulator member 42, and said element 50 passing through a guide aperture 52 formed in a control member 53 which is part of the control system 15 as will be described. Power is supplied to the electric motor from a power source (not shown) via power wires 54 connected by means of slip-rings 55 and leads 56, to associated track elements 12.

Figure 4:
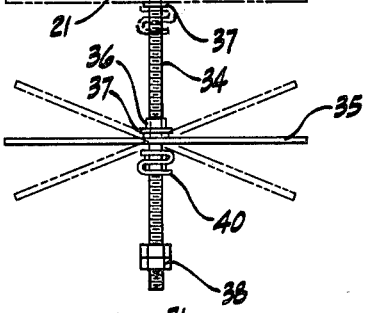
FIG. 4 is a fragmentary sectional view taken on line 4—4 of FIG. 3.
Figure 4:
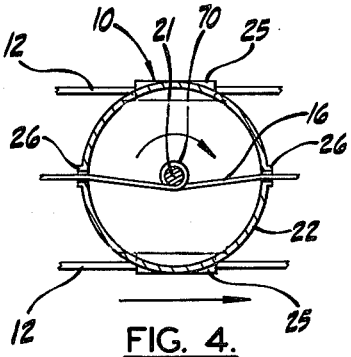
Figure 5:
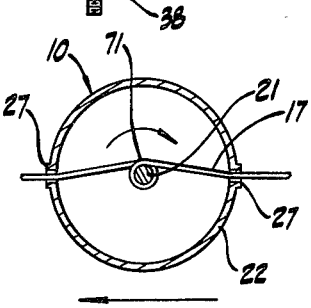
FIG. 5 is a sectional view taken on line 5—5 of FIG. 3.
Figure 3:
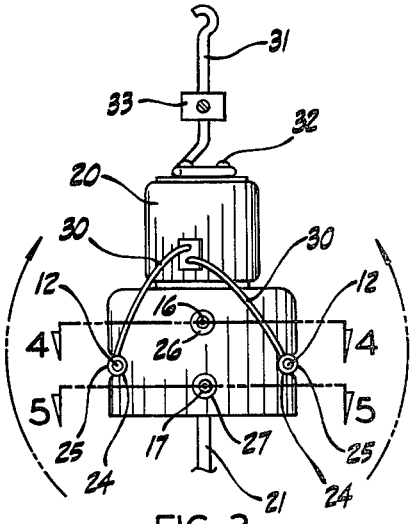
FIG. 3 is a fragmentary sectional view through the track taken on line 3—3 of FIG. 2.

The clutch control elements 16 and 17 extend between the control member 53, which is provided with spaced retaining apertures 60 and 61 receiving said control elements 16 and 17 respectively; and the end insulator member 41, which is provided with a retaining aperture 62 receiving and retaining both of said control elements. As clearly shown in FIG. 2, the end insulator member 42 is provided with spaced guide apertures 63 and 64 respectively, receiving said control elements 16 and 17 therethrough. As noted above, control elements 16 and 17 are received through opposed housing apertures 26 and 27 respectively. Importantly, as illustrated in FIGS. 4 and 5 respectively, each of said control elements 16 and 17 is wrapped around the motor shaft 21, within the housing 22, at least one turn or loop. The loop 70 of element 16 is wrapped in the opposite direction to the loop 71 of said element 17. In the preferred embodiment, elements 16 and 17 are cords having a friction clutch relationship with said motor shaft 21, such that when tension is applied to one element only, the amusement device moves in one longitudinal direction, and when tension is applied to the other element only, the device moves in the opposite longitudinal direction.

It is thought that the structural and functional features of this amusement device have become fully apparent from the foregoing description of parts, but for completeness of disclosure the installation and operation of the device will be briefly described.

The track system 11 is suspended between supports 13 and 14 by attaching support elements 45 and 50 respectively to said supports, as by screws 18 and 19. Power supplied to the track elements 12 from the power wires 54, via slip rings 55, reaches the electric motor 20 through the medium of conductor sleeves 25 and electric leads 30 attached to said sleeves, thereby causing the motor shaft to rotate. Because of the flywheel 35, attached to the motor shaft 21, the action of the device tends to be gyroscopic in nature. The control system 12 is actuated by applying tension to one or the other of the control elements 16 and 17, as by manipulating the control member 53 as shown in FIG. 2. With the motor shaft rotating in a clockwise direction, as shown in FIGS. 4 and 5, a pull applied to element 16 tightens the loop 17 of said element about the shaft 21, tending to cause the device to travel longitudinally in the direction indicated in FIG. 4, whereas a similar pull applied to element 17 tightens the loop 71 tending to drive the device 10 in the opposite longitudinal direction as indicated in FIG. 5. An equal pressure applied to both elements will result in no longitudinal movement. Similarly, a complete relaxation of pressure will result in no longitudinal movement. It will be understood that in the event that a reversible switch is provided for the motor 20, to permit the motor shaft 21 to rotate in a clockwise of counter-clockwise direction as desired, a single clutch element can be used to achieve the drive effect. Further, an internal combustion motor can be used in lieu of the electric motor shown.

Continuous or partial rotation of the device 10 as a whole, in a plane perpendicular to the direction of longitudinal travel, can be accomplished by pivotally manipulating the end insulator member 42 about a point defined by the connection of the support element 50 to said member, as shown in FIG. 2, which changes the tension of the track elements 20, thereby changing the relative support elevation of each side of the device and causing the center of gravity of the device as a whole to swing in a plane transverse to the direction of the longitudinal travel. The device can thus be rotated through one hundred eighty degrees (180°). When this occurs the relative positions of the flywheel 35 and the counter-weight 33 are reversed. Continuous or partial rotation can be accomplished directly by rotating control member 53 in that plane. It will be understood that both the flywheel 35 and the counter-weight 33 can be adjusted to change the balancing characteristics of the device. This is accomplished by simply moving one or both of said elements relative to the shaft 21 and the hook 31 respectively. When 180° rotation is accomplished the hook 31 is disposed downwardly and is capable of picking up, for example, rings (not shown), which are located in the vicinity of travel of the device, and carrying them to specific locations or target areas.

Importantly, as the device 10 rotates in a plane transverse to the direction of longitudinal travel in response to the rotation of the control members 53 the gyroscopic action of the flywheel 35 tends to resist this rotation. Because of the resilient connection provided by the hub sleeve 35, the flywheel deflects resulting in an angular displacement away from the perpendicular relationship between the said flywheel and the motor shaft 21, as indicated in phantom outline in FIG. 1. This deflection of the resilient hub stores energy and causes the device 10 to continue to rotate even when the operator releases the control member 53. It should be noted conversely that a system not provided with a resilient connection tends to offer greater resistance to rotation because of increased gyroscopic action.

Remote movement of the flywheel 35 is accomplished by manipulation of the speed and direction of the motor shaft 21 to cause sufficient torque to overcome the friction between the threaded shaft portion 34 and friction strap assembly 40. When the friction is overcome relative rotation of the flywheel and shaft occurs resulting in relative movement of said flywheel and strap assembly along said shaft longitudinal axis. The resilient connection between the flywheel 35 and the hub sleeve 37 permits the flywheel to flex in the event that it engages an obstacle in its path.

The variation in movements described above permits the amusement device 10 to be used in many and vaired ways involving considerable exercise of skill by the operator.

It will be understood that in lieu of suspended attachment of the track system between two supports, the track system can be attached to a fixed support means at one end only, the other end being held by the operator to provide the suspended relation between the ends.

I claim as my invention:

1. An amusement device, comprising:

(a) an elongate suspended track, (b) means carrying a rotatable shaft, said means including a motor for rotating said shaft and moving said shaft longitudinally of said track, (c) means for mounting said shaft carrying means to said track and (d) a flywheel carried by said shaft and including resilient connection means between said flywheel and said shaft to permit rotation of said flywheel in a plane other than a plane perpendicular to said shaft.

2. An amusement device, comprising:

(a) support means, (b) an elongate track including opposed ends, and having at least one of said ends attached to said support means, (c) a motor including a shaft, (d) means operatively connected to said shaft for driving said motor on said track, and (e) a flywheel carried by said shaft and including resilient connection means between said flywheel and said shaft to permit rotation of said flywheel in a plane other than a plane perpendicular to said shaft.

3. An amusement device, comprising:

(a) support means, (b) a longitudinally extending track including a pair of transversely disposed end members, a pair of elongate elements disposed in side-by-side relation and extending between said end members, and an end support element extending between one of said end members and said support means, (c) a motor including a vertically disposed elongate shaft having a threaded portion, (d) a flywheel mounted on the threaded portion of the shaft for selective rotation relative to the shaft, to adjust the position of the flywheel on the shaft, (e) a housing carried by the motor, and having a pair of apertured transversely spaced bearing means receiving said track elements in sliding relation to operatively guide the motor on the track, and (f) clutch control means including a pair of elongate clutch elements each having one end operatively connected to the support means and a tension control member operatively connected to the other end of each of said clutch elements, each of said clutch elements being wrapped at least one turn around the shaft in frictional relation, said turn of one of said elements being in the opposite direction to the turn of said other element whereby to selectively drive said motor on said track in one direction when said control member applies tension to one of said clutch elements, and in the other direction when said control member applies tension to the other of said clutch elements.

4. An amusement device as defined in claim 3, in which:

(g) said motor is an electric motor, (h) said track elements are electrically conductive, (i) said bearing means are conductor sleeves connected to said electric motor in electrically conductive relation, and (j) an electric power source is connected to said track elements.

5. An amusement device, comprising:

(a) support means, (b) an elongate flexible track including opposed ends, and having at least one of said ends attached to said support means, (c) a motor including a shaft, (d) guide means between the motor and the track to guide the motor on said track, (e) clutch control means independent of said track including at least one elongate flexible element extending generally in the same direction as said track and wrapped at least one turn about said shaft in frictional relation thereto, whereby to selectively drive said motor on said track, (f) the shaft carrying a flywheel coaxially rotatable with said shaft, and (g) the flywheel including a resilient connection means between said flywheel and said shaft to permit rotation of said flywheel in a plane other than a plane perpendicular to said shaft.

6. An amusment device, comprising:

(a) support means, (b) an elongate flexible track including opposed ends, and having at least one of said ends attached to said support means, (c) a motor including a shaft, (d) guide means between the motor and the track to guide the motor on said track, (e) clutch control means independent of said track including at least one elongate flexible element extending generally in the same direction as said track and wrapped at least one turn about said shaft in frictional relation thereto, whereby to selectively drive said motor on said track, (f) the motor being provided by an electric motor, (g) the track including a pair of elongate electrically conductive track elements disposed in side-by-side relation and operatively connected to said motor in electrically conductive relation, (h) the guide means including a housing, carried by the motor and having oppositely disposed apertured conductor elements in electrically conductive sliding relation, and (i) an electric power source being operatively connected to said elongate conductor elements.

7. An amusement device, comprising:

(a) support means, (b) an elongate flexible track including opposed ends, and having at least one of said ends attached to said support means, (c) a motor including a shaft, (d) guide means between the motor and the track to guide the motor on said track, (e) clutch control means independent of said track including at least one elongate flexible element extending generally in the same direction as said track and wrapped at least one turn about said shaft in frictional relation thereto, whereby to selectively drive said motor on said track, (f) the clutch control means including a pair of elongate clutch elements, each wrapped at least one turn about said shaft in frictional relation, said turn of one of said elements being in the opposite direction to the turn of the other of said elements, whereby the selective application of tension to one of said clutch elements drives said motor on said track in one direction and the application of tension to the other of said elements drives said motor on said track in the opposite direction, (g) the track including longitudinally spaced, transversely disposed end members, a pair of elongate track elements disposed in side-by-side longitudinally extending relation between said end members, and connection means between one of said end members and said support means to permit said track elements to be rotated in a transverse plane, and (h) the clutch control means including a transverse member and means connecting the same end of said clutch elements to spaced points on said transverse element, whereby selective movement of said transverse member controls the tension in said clutch elements.

8. An amusement device, comprising:

(a) support means, (b) an elongate flexible track including opposed ends, and having at least one of said ends attached to said support means, (c) a motor including a shaft, (d) guide means between the motor and the track to guide the motor on said track, (e) clutch control means independent of said track including at least one elongate flexible element extending generally in the same direction as said track and wrapped at least one turn about said shaft in frictional relation thereto, whereby to selectively drive said motor on said track, (f) the shaft carrying a flywheel coaxially rotatable with said shaft, (g) the shaft including a threaded portion, (h) the flywheel including friction means threadedly connecting said flywheel to said shaft in lengthwise adjustable relation, and (i) an elongate member being mounted above the motor in oppositely extending relation to said shaft said elongate member having a counter-balance weight movably mounted thereto in lengthwise adjustable relation.

* * * * *